US010107153B2

(12) United States Patent
Boese et al.

(10) Patent No.: US 10,107,153 B2
(45) Date of Patent: Oct. 23, 2018

(54) CAMSHAFT ADJUSTMENT DEVICE FOR AN INTERNAL COMBUSTION ENGINE

(71) Applicant: Schaeffler Technologies AG & Co. KG, Herzogenaurach (DE)

(72) Inventors: Olaf Boese, Nuremberg (DE); Jochen Thielen, Nuremberg (DE)

(73) Assignee: Schaeffler Technologies AG & Co. KG, Herzogenaurach (DE)

( * ) Notice: Subject to any disclaimer, the term of this patent is extended or adjusted under 35 U.S.C. 154(b) by 127 days.

(21) Appl. No.: 15/327,195

(22) PCT Filed: Mar. 27, 2015

(86) PCT No.: PCT/DE2015/200207

§ 371 (c)(1),
(2) Date: Jan. 18, 2017

(87) PCT Pub. No.: WO2016/012011

PCT Pub. Date: Jan. 28, 2016

(65) Prior Publication Data

US 2017/0159510 A1 Jun. 8, 2017

(30) Foreign Application Priority Data

Jul. 25, 2014 (DE) ..... 10 2014 214 610

(51) Int. Cl.
*F01L 1/46* (2006.01)
*F01L 1/344* (2006.01)
*F01L 9/02* (2006.01)

(52) U.S. Cl.
CPC ..... *F01L 1/3442* (2013.01); *F01L 9/02* (2013.01); *F01L 1/46* (2013.01);
(Continued)

(58) Field of Classification Search
CPC ... F01L 2001/34426; F01L 2001/34433; F01L 2001/34479; F01L 1/46
(Continued)

(56) References Cited

U.S. PATENT DOCUMENTS 6,289,862 B1 * 9/2001 Schafer ..... F01L 1/3442 123/90.17
6,601,554 B1 * 8/2003 Schafer ..... F01L 1/3442 123/90.17
(Continued)

FOREIGN PATENT DOCUMENTS

DE 102008037997 2/2010
DE 102010019530 11/2011
(Continued)

*Primary Examiner* — Jorge Leon, Jr.
(74) *Attorney, Agent, or Firm* — Volpe and Koenig, P.C.

(57) ABSTRACT

The invention relates to a camshaft adjustment device for an internal combustion engine, having a chamber housing, an actuating rotor which is received in the chamber housing and which can be pivoted about an axis which is concentric with respect to the circumferential axis of the chamber housing, wherein the actuating rotor has a plurality of dividing flanks which rise up radially over a cylindrical base surface of the actuating rotor, and in each case divide pressure chambers which are formed in the chamber housing into a first chamber section and a second chamber section. Sealing strips are inserted into the actuating rotor. The sealing strips form a fluid passage path. The latter can be blocked via a check valve device in such a way that the fluid passage is possible only in one direction.

10 Claims, 13 Drawing Sheets

(52) U.S. Cl.
CPC ..... *F01L 2001/34433* (2013.01); *F01L 2001/34446* (2013.01); *F01L 2001/34479* (2013.01)

(58) Field of Classification Search
USPC ..... 123/90.17
See application file for complete search history.

(56) References Cited

U.S. PATENT DOCUMENTS

| | | | | |
|---|---|---|---|---|
| 2001/0017117 | A1* | 8/2001 | Golbach | F01L 1/3442 123/90.16 |
| 2003/0200944 | A1* | 10/2003 | Takahashi | F01L 1/3442 123/90.15 |
| 2005/0022763 | A1* | 2/2005 | Kobayashi | F01L 1/3442 123/90.17 |
| 2013/0025553 | A1 | 1/2013 | Busse et al. | |
| 2013/0199471 | A1 | 8/2013 | Schafer et al. | |
| 2013/0199476 | A1* | 8/2013 | Schafer | F01L 1/3442 123/90.17 |
| 2014/0090612 | A1* | 4/2014 | Hayashi | F01L 1/3442 123/90.15 |

FOREIGN PATENT DOCUMENTS

| | | | |
|---|---|---|---|
| DE | 102012201553 | 8/2013 | |
| DE | 102012201558 | 8/2013 | |
| DE | 102012201561 | 8/2013 | |
| JP | 2001221016 | 8/2001 | |
| WO | WO 2006127348 A1 * | 11/2006 | F01L 1/34409 |
| WO | 2008042621 | 4/2008 | |

* cited by examiner

CAMSHAFT ADJUSTMENT DEVICE FOR AN INTERNAL COMBUSTION ENGINE

FIELD OF THE INVENTION

The invention relates to a camshaft adjustment device for an internal combustion engine for setting the phase position of a camshaft relative to a camshaft drive wheel, wherein the camshaft adjustment device comprises a chamber housing surrounding the camshaft drive wheel and an actuating rotor held therein. The actuating rotor is arranged concentric to the axis of rotation of the chamber housing and is arranged so that it can pivot in the chamber housing, so that the actuating rotor can be pivoted in the interior of the housing relative to the housing, and in this way about its axis of rotation over a structurally defined angular range. The actuating rotor here has multiple chamber flanks that project radially outward and form multiple oil chamber sections in each chamber of the housing in interaction with radially inward projecting webs of the chamber housing. The chamber flanks are equipped with sealing strips, wherein the oil chamber sections each separated by a chamber flank of the actuating rotor are sealed relative to each other. The sealing strips are here inserted into radial grooves that are formed in the chamber flanks.

BACKGROUND

Through the use of camshaft adjustment devices, in a 4-stroke internal combustion engine it is advantageously possible to change the phase position of a camshaft relative to a drive wheel driven by a timing chain, a toothed belt, or some other type of drive system. In this way it is possible to adjust the control times of the valves driven by each camshaft advantageously to the instantaneous load state of the internal combustion engine.

SUMMARY

The invention is based on the objective of creating a camshaft adjustment device in which a required setting of the phase position of a camshaft relative to a drive wheel can be created by oil-hydraulic paths and advantages are produced for the sealing of the chamber sections and the realization of internal fluid connection paths.

The object stated above is achieved according to the invention by a camshaft adjustment device for an internal combustion engine, with:

- a chamber housing
- an actuating rotor that is held in the chamber housing and can be pivoted about an axis that is concentric to the axis of rotation of the chamber housing, and
- sealing strips that are inserted into the actuating rotor such that these divide each pressure chamber formed in the chamber housing into a first chamber section and a second chamber section,
- wherein, in each sealing strip, a fluid connection path is formed that connects the first and the second chamber sections and this fluid connection path can be blocked by a check valve device that is open in only one fluid flow direction and is otherwise closed.

In this way it is advantageously possible to realize a fluid connection path directly via each sealing strip, wherein this path allows a fluid passage in one flow direction and blocks the fluid passage in the opposite direction.

The sealing strip and the check valve device here preferably form a sub-assembly that is completed before the sealing strip is inserted into the actuating rotor.

The check valve device preferably comprises a closing element that is slightly biased in a closed position in the base state. This closing element is preferably formed as a flat disk that sits on the opening area of a hole. As an alternative, the closing element can also be constructed as a ball-like, dome-like, or also merely, for example, as a conical component, which is suitable for blocking a fluid passage path in one structurally defined direction and allowing a fluid passage in the opposite direction.

One embodiment of the invention that is especially advantageous with respect to high functional reliability and minimal requirements for installation space is given in that the check valve device comprises a flat valve plate. This valve plate is preferably made from a steel material, in particular, a structurally treated spring steel material. The valve plate can be shaped so that the valve plate comprises a spring arm, wherein this spring arm has a smaller width than the head section of the valve plate optionally blocking the fluid connection path. Each head section then forms the closing element mentioned generally above.

The check valve device can be further constructed advantageously so that the spring arm is positioned on the allocated sealing strip. Here, a positioning geometry, e.g., in the form of a depression, hole, slot, or pocket can be formed on the sealing strip, through which the spring arm can be fixed in the correct position on the sealing strip. The spring arm can be fixed directly on the allocated sealing strip. The fixing of the check valve device can also be implemented so that this is produced only after the sealing strip is inserted into the actuating rotor and in this way just in interaction with the actuating rotor.

The control time actuating device according to the invention is preferably constructed such that the sealing strips are inserted so that they can move at least slightly in the radial direction in a guide groove formed in a dividing flank of the actuating rotor, wherein in each sealing strip a guide geometry is also formed and an additional valve element is guided on this guide geometry such that this can be moved according to the measure of an oil pressure applied to the valve element into different positions, wherein the fluid passage already controlled by means of the check valve can be adjusted, in particular, blocked, by means of this valve element through each fluid connection path running in the sealing strip.

The camshaft adjustment device can further be constructed so that this comprises a drive wheel that is connected as such to the chamber housing. The camshaft is then connected to the actuating rotor. The drive wheel can be constructed here, in particular, as a chain or toothed belt wheel or also as a gear for a wheel drive. The drive wheel can take over the function of a housing part, in particular, a closing cover of the chamber housing. As an alternative to the construction described above, it is also possible in a type of kinematic reversal, to connect the specified drive wheel to the actuating rotor and then the camshaft to the chamber housing. In this variant, the actuating rotor can be guided so that it rotates precisely advantageously to an end section of the camshaft.

The sealing strip can be formed according to one especially preferred embodiment of the invention such that the guide geometry guides the valve element so that it can be moved radially relative to the axis of rotation. The valve element can be constructed so that it has a non-round cross section, wherein a guide pocket with a complementary cross section is then formed in the sealing strip. One alternative that is especially advantageous with respect to production relative to the variant specified above consists in that the valve element is shaped so that it has a circular cross section. In the sealing strip, a cylindrical blind hole is then formed in which the valve element is guided so that it can move smoothly with the typical passages for slider valves. This valve element can then block the fluid connection path that can be blocked unidirectionally by the check valve device actuated by oil pressure.

It is also possible to integrate a mechanism in the sealing strip through which the blocking effect of the check valve device can be reversed. It is also possible to integrate a mechanism in the sealing strip through which the check valve device can be temporarily locked so that this does not open. It is also possible to integrate a mechanism in the sealing strip through which the blocking effect of the check valve device can be canceled, so that this is permanently opened. This mechanism can comprise, in turn, a valve or switch element that can be moved in a defined way by applying oil pressure on a control channel, which offers the previously mentioned functions to the check valve device, in particular, to the plate valve head, in the set switching position, in interaction with the mechanism.

The valve element and the sealing strip are preferably supported against each other by a spring device. This spring device can be constructed as a helical or cylindrical spring that is biased slightly in the axial direction, wherein this spring device can be positioned in a pocket formed in the sealing strip.

The valve arrangement realized in interaction between the sealing strip and valve element is preferably constructed so that the valve element is open toward the base area of the sealing strip and the valve element is pressured with compressed oil from the area of the groove base of the guide groove formed in the actuating rotor. Then, also for the assembly of the camshaft adjustment device, the valve element can be inserted into the sealing strip from this lower base area.

The invention is essentially directed toward a camshaft adjuster for a control drive, in particular, in the form of a chain or belt drive. Here, a valve element is integrated into the sealing strips or flanks by means of which a hydraulic open circuit and, in particular, a blocking of the agent, can be created, which is required as needed. The valve elements are controlled by oil pressure and are biased by a compression spring in a starting position. The fluid passage is also controlled by a so-called check valve, i.e., a valve that allows fluid passage in only one direction.

The use of valve elements (also control pistons) in the sealing strips produces an advantageous use of the installation space and the material of the sealing strips. According to the invention, that is, in the needed sealing strips, the function of a valve mechanism is integrated. The connection of the check valve to each sealing strip produces an advantageous formation of a sub-assembly.

In the context of the present description, the device designated as a check valve is a system that comprises a valve or blocking mechanism that has the effect that a fluid flow guided via this system can flow only in one flow direction, but a flow in the opposite direction is prevented by a blockage. Smaller oil flows in the opposite direction, especially oil flows that occur or are necessary until the check valve is closed, are permitted in this way. In the present example, the check valve is preferably designed so that it controls the fluid passage with high dynamic response, so that, for example, dynamic pressure fluctuations in the chamber sections caused, for example, by changes in the loads, can trigger an oil flow in a direction defined by the check valve device.

BRIEF DESCRIPTION OF THE DRAWINGS

Additional details and features of the invention are given from the subsequent description in connection with the drawing. Shown are.

DETAILED DESCRIPTION OF THE PREFERRED EMBODIMENTS

Figure 1A:
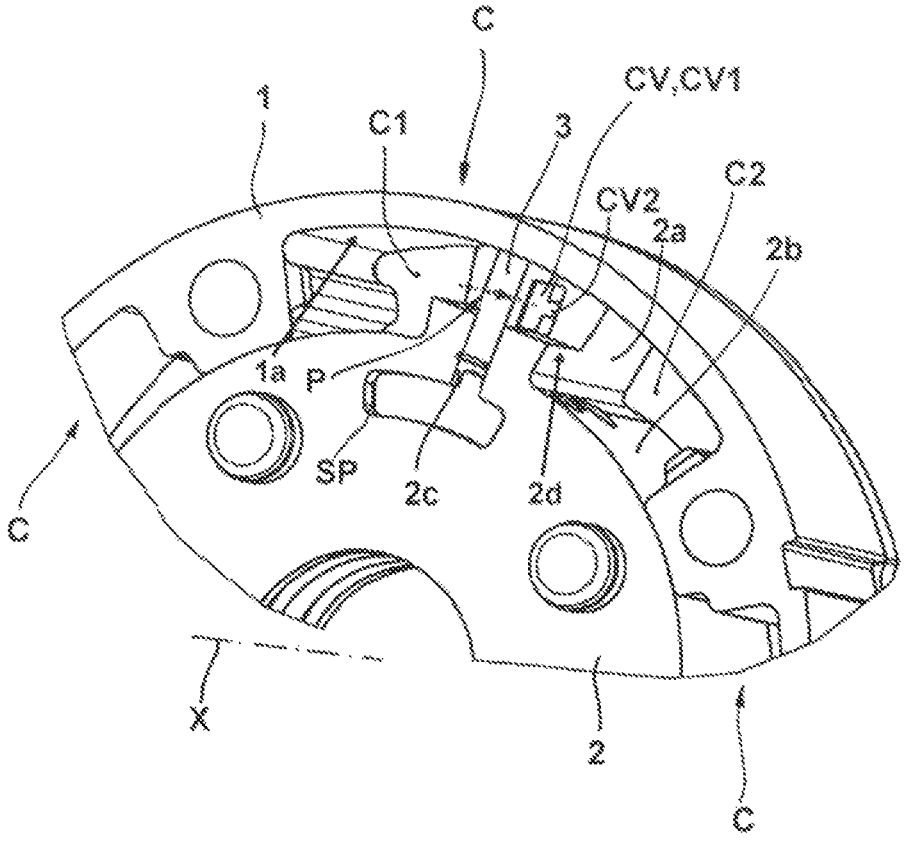
FIG. 1A a perspective detailed view for explaining the setup of a camshaft adjustment device according to the invention, FIG. 1B a radial section view of the camshaft adjustment device according to the invention according to FIG. 1A, FIG. 1C an axial section view of the camshaft adjustment device according to the invention according to FIG. 1A, FIG. 2A a perspective view for explaining the setup of a sealing strip according to the invention with a valve device integrated in this strip, FIG. 2B a perspective view of the rear side of the sealing strip according to FIG. 2A, now for explaining the setup of the check valve, FIG. 2C an individual part view for explaining the setup of a sealing strip with integrated check valve device according to FIGS. 2A and 2B, FIG. 3A a perspective view for explaining the setup of a sealing strip according to the invention with a valve device integrated in this strip according to a second embodiment of the invention, FIG. 3B a perspective view of the rear side of the sealing strip according to FIG. 3*a*, now for explaining the setup of the check valve, FIG. 3C an individual part view for explaining the setup of a sealing strip with integrated check valve device according to FIGS. 3A and 3B, FIG. 4A a perspective view for explaining the setup of a sealing strip according to the invention with a valve device integrated in this strip according to a third embodiment of the invention, FIG. 4B an individual part view for explaining the setup of a sealing strip with integrated check valve device according to FIG. 4A, FIG. 5A a perspective view for explaining the setup of a sealing strip according to the invention with a valve device integrated in this strip according to a fourth embodiment of the invention, next to a separately illustrated valve element and a separately illustrated valve spring, FIG. 5B an individual part view for illustrating the setup of the sealing strip, the valve plate, and a retaining frame of the check valve device according to FIG. 5A, FIG. 6 a perspective view for explaining the setup of a sealing strip according to the invention with a valve device integrated in this strip according to a fifth embodiment of the invention with integrated valve stop for limiting the opening stroke.

The diagram according to FIG. 1A shows, in the form of a perspective detailed view, a camshaft adjustment device according to the invention for an internal combustion engine. This comprises a chamber housing 1, an actuating rotor 2 that is held in the chamber housing 1 and that can be pivoted relative to the chamber housing 1 about an axis that is concentric to the axis of rotation X of the chamber housing 1, wherein the actuating rotor 2 has multiple dividing flanks 2*a* that project radially above a cylindrical base surface 2*b* of the actuating rotor 2 and divide each pressure chamber C formed in the chamber housing 1 into a first chamber section C1 and a second chamber section C2. The camshaft adjustment device according to the invention also comprises sealing strips 3 that are inserted so that they can move radially in a guide groove 2*c*, with each guide groove 2*c* extending in a dividing flank 2*a* of the actuating rotor 2, and contact, in a sealing way, the inner wall 1*a* of the chamber housing 1.

According to the invention, a fluid connection path P that is only indicated here and as such connects the first and the second chamber sections C1, C2 is formed in the respective sealing strip 3, wherein, in this fluid connection path P, a check valve device CV is integrated. Through this check valve device CV it is advantageously possible to permit a fluid passage in a flow direction defined by the structural type of the check valve device CV directly through the fluid connection path P running through the respective sealing strip 3 and to block a fluid passage in the opposite direction.

In the embodiment shown here, the check valve device CV comprises a valve plate CV1 that is connected to a spring arm CV2. The spring arm CV2 is fixed, as will be further discussed below, on the allocated sealing strip 3.

As also discussed in connection with the description of the other figures, a guide geometry is formed in the respective sealing strip 3 and a valve element not shown here is guided in this guide geometry such that it can be displaced into different positions according to the measure of an oil pressure applied to the valve element. The oil pressure for actuating the valve element is applied via the oil channel SP that can be seen here, which opens into the base area of the guide groove 2*c* of the actuating rotor 2. The specified valve element not yet visible in this view also affects the fluid flow via the fluid connection path P.

As can be further seen from the view according to FIG. 1A, each dividing flank 2a holding the sealing strip 3 is shaped such that it forms a recess 2*d* in the area of the fluid connection path P. This recess 2*d* is open in the shown embodiment both toward the inner wall 1*a* of the chamber housing 1 and also toward a cover laterally covering the chamber housing 1 (see FIG. 1C reference symbol 1*e*). The recess 2*d* formed in this way can be made depending on the production technology advantageously directly within the scope of an early production step leading to the formation of the actuating rotor, in particular, in the scope of a casting method, a sintering method, or a shaping method and allows relatively large dimensional tolerances in this shape. The recess 2*d* can be constructed on the side facing the valve plate CV1 so that here a larger clearance is produced than on the side of the sealing strip 3 facing away from the valve plate CV1. The sealing strip 3 is guided in each guide groove 2*c* formed in the dividing flank 2*a* with tight movement play. In the surrounding area of the spring arm CV2, a recess can be formed in the guide groove 2*c*, which imparts a sufficient motion space to the spring arm CV2. It is also possible to form the recess 2*d* so that it provides a motion space sufficient for adequate lifting of the spring arm CV2.

As an alternative to the shape of the fluid path guided via the dividing flank 2*a*, which is especially advantageous in terms of production technology, in the form of a recess 2*d* that is open at the edges, it is also possible to form, in the dividing flank 2*a*, a hole or some other recess that allows a fluid flow via the fluid connection path P leading through the sealing strip 3. As far as the entire construction allows it, it is also possible to anchor the sealing strips 3 deep in the actuating rotor 2 such that the dividing flanks 2*a* can be eliminated or these are reduced with respect to their radial projection over the base surface 2*b* of the actuating rotor so far that the valve plate CV1 and optionally also the whole spring arm CV2 come free from the actuating rotor 2.

In the embodiment shown here, the contact geometry between the visible sealing strip 3 and the inner wall 1*a* of the chamber housing 1 is shown simplified. In the area of each edge surface of the sealing strip 3*a* facing the inner wall la, in particular, surface curvatures, grinding patterns, and optionally also other sealing agents, in particular, elastomer inserts that support the sealing effect of the sealing strips 3. The lateral flanks of the sealing strips 3 can be constructed so that these offer an especially high sealing effect relative to the adjacent radial surfaces of the closure cover of the chamber housing 1. In the sealing strips 3 or the grooves 2*c*, sealing agents, in particular, elastomer inserts, can also be provided that prevent a fluid passage through the adjacent movement gap area. The actuating rotor 2 and the chamber housing 1 are preferably matched to each other with respect to the materials being used and the provided dimensions so that movement gap dimensions that are too narrow or too large cannot be set in the scope of the practice-relevant temperature spectrum.

Figure 1B:
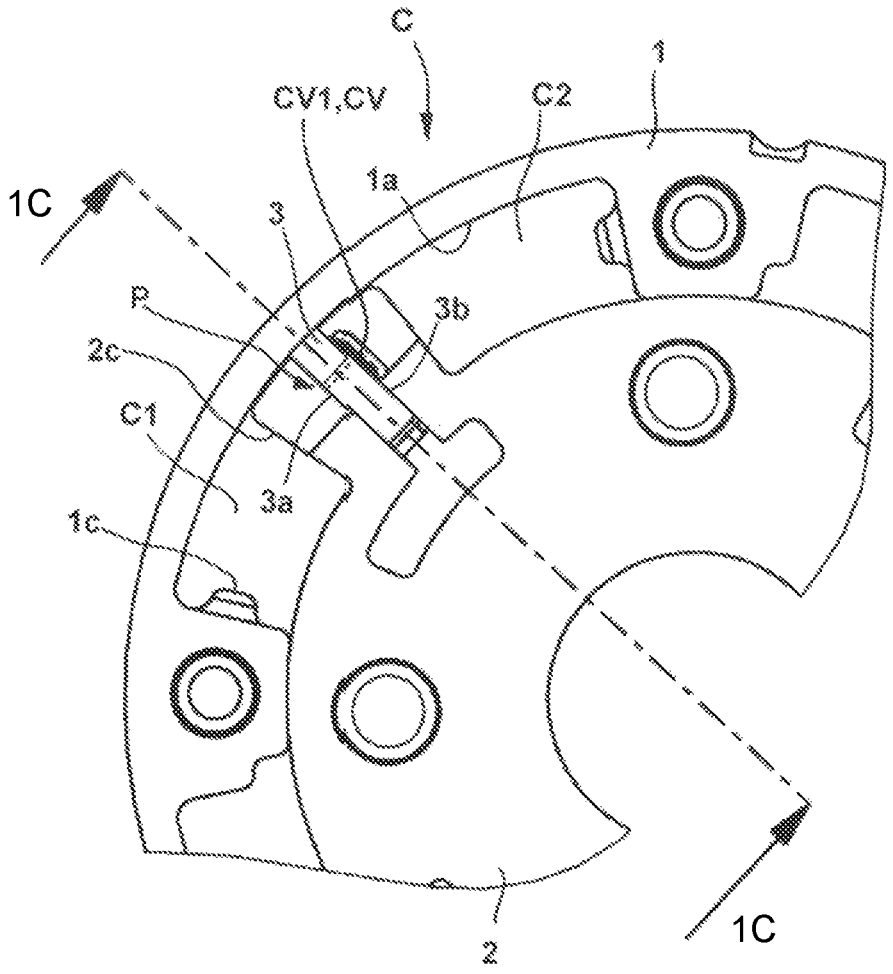

The view according to FIG. 1B shows the setup of the control time actuating device according to the invention according to FIG. 1A in radial section. The sealing strip 3 divides the oil chamber C into the two chamber sections C1, C2. The sealing strip 3 here contacts, in a sealing manner, the inner surface 1*a* of the chamber housing 1 shaped as a cylinder wall. The fluid connection path P connecting the two chamber sections C1, C2 is shaped as a hole that extends between the flat sides 3*a*, 3*b* of the sealing strip 3. The head section of valve plate CV1 of the check valve device CV shaped as a leaf spring valve sits on the surrounding area of the hole opening into the second chamber section C2. In the arrangement shown here, the check valve device CV can move into an opening state when the fluid pressure prevailing in the first chamber section C1 is above the pressure of the fluid in the second chamber section C2. In this case, the fluid located in the chamber section C1 flows out via the fluid connection path P into the second chamber section C2 and in this way, the actuating rotor 2 in the chamber housing 1 can pivot until the radial wall 2*e* of the actuating rotor 2 visible in this view sits on the end stop 1*c* of the chamber housing. A pivoting of the actuating rotor 2 in the opposite direction is enabled in that a fluid outflow from the second chamber section C2 by some other kind of valve device not shown here, as well as a fluid inflow to the first chamber section C1 is enabled. As will be explained in more detail below in connection with FIG. 1C, another valve device is provided in the sealing strip 3, through which the fluid connection path P shown here only as an example can be blocked.

Figure 1C:
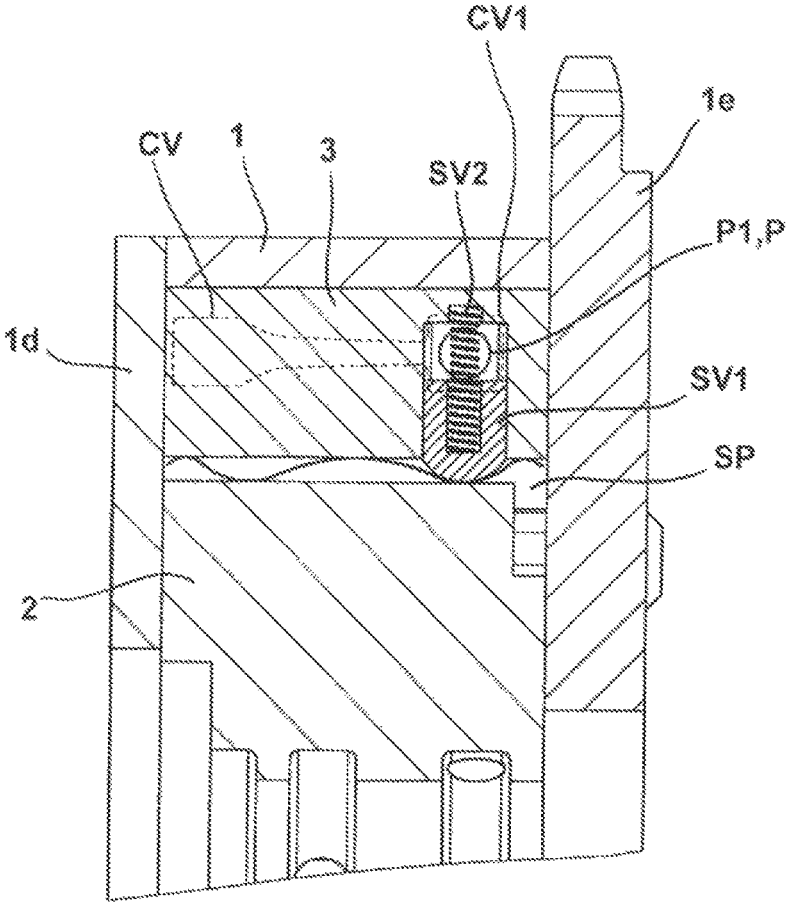

The view according to FIG. 1C shows the setup of the control time actuating device according to FIG. 1B in axial section. The section plane here runs along the section line 1C-1C shown in FIG. 1B. As can be seen now, a control valve element SV1 through which the fluid connection path P realized as a hole P1 can be selectively blocked sits in the sealing strip 3. The control valve element SV1 is biased by a spring device SV2 into an open position. By applying a fluid pressure on the oil channel SP visible here, it is possible to generate an actuating force on the end side of the control valve element SV1 facing the actuating rotor 2, which has the effect that the control valve element SV1 is displaced radially outward against the restoring force of the spring device SV2. As soon as the control valve element SV1 reaches its end position, the fluid connection path P is interrupted by the control valve element SV1.

The chamber housing 1 visible here is covered axially by a chamber housing cover 1*d* and a drive wheel 1*e*. The actuating rotor 2 is guided so that it can pivot, sealed, between the chamber housing cover 1*d* and the drive wheel 1*e* while leaving a sufficient movement play. The check valve device CV shown in this view by dashed lines is constructed as a leaf spring valve and fixed on the sealing strip 3. The valve plate CV1 only partially visible in this view sits on the surrounding area of the passage hole P1. The bottom side of the valve plate CV1 and the flat side of the sealing strip 3 facing this head here form a closed surface system. This includes an opening state when the valve plate CV1 is raised from the sealing strip 3 and it includes a closed state when the valve plate CV1 contacts the sealing strip 3.

Figure 2A:
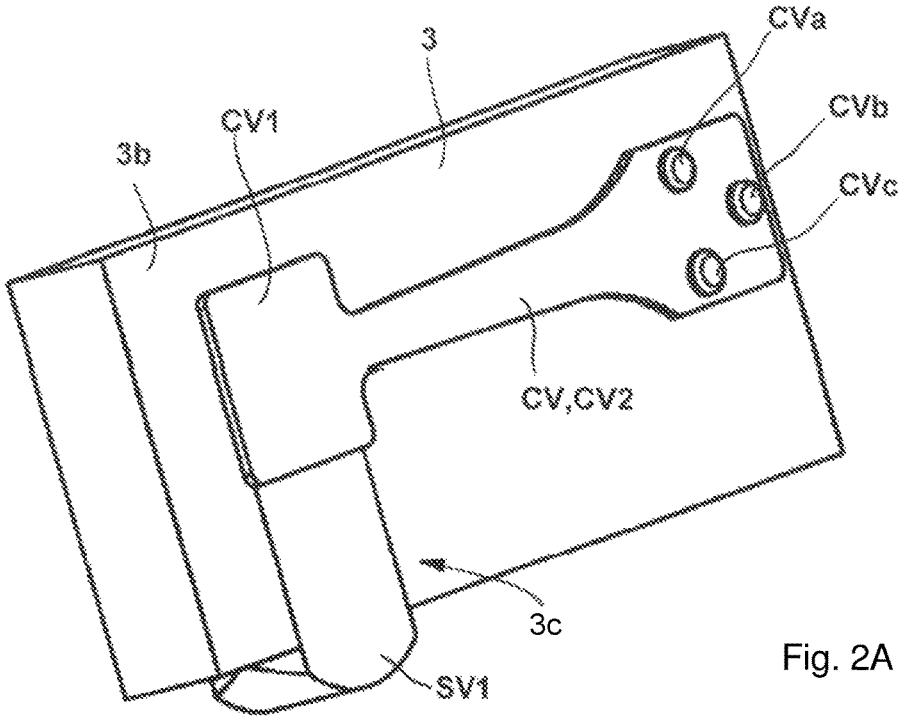

The view according to FIG. 2A shows an embodiment of a sealing strip 3 of a control time actuating device according to the invention, in which the check valve device CV is constructed as a leaf spring valve. The leaf spring valve CV comprises a spring arm section CV2 that is mounted by means of multiple fasteners CVa, CVb, CVc on the base body forming the sealing strip 3. The check valve device CV comprises a valve plate CV1 that sits on a side surface 3*b* of the sealing strip 3. A pocket 3*c* is formed in the sealing strip 3 in which a control valve element SV1 is inserted. This control valve element SV1 has a prismatic cross section and is guided in a translational motion in the sealing strip. The control valve element SV1 forms a side surface on which a partial zone of the valve plate CV1 sits.

Figure 2B:
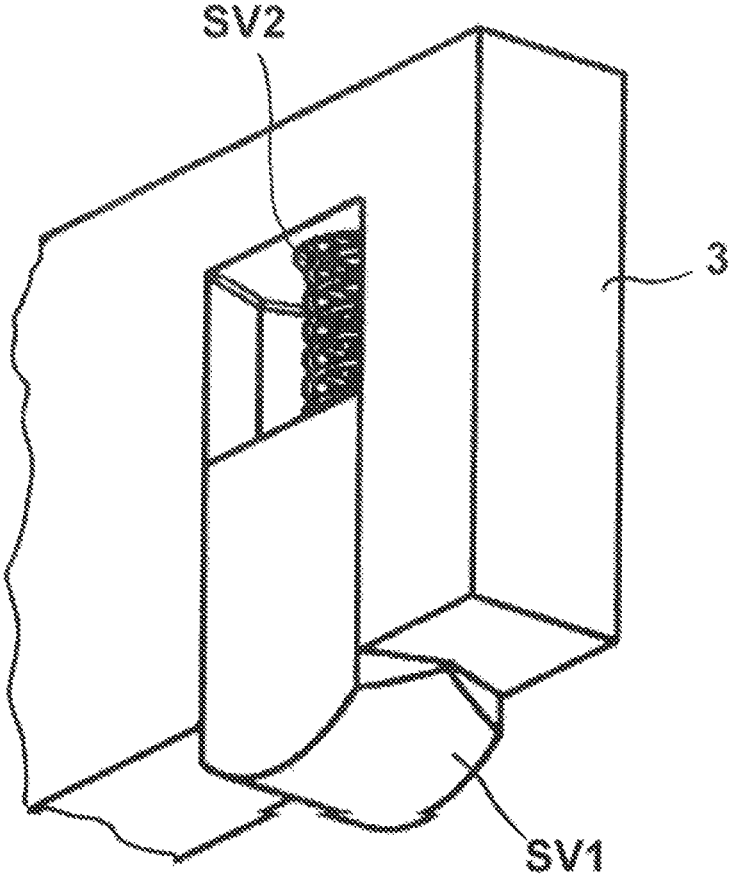

As is visible from FIG. 2B, a spring device SV2 is also provided in this embodiment, through which the control valve element SV1 is biased into an open position. The control valve element SV1 has a prismatic cross section. The receptacle pocket formed in the sealing strip 3 has a complementary cross section. The control valve element SV1 is guided here in the sealing strip 3 such that the control valve element SV1 can be moved only in a translational manner in the pocket, but cannot be pushed laterally out from the pocket toward the large flat sides.

Figure 2C:
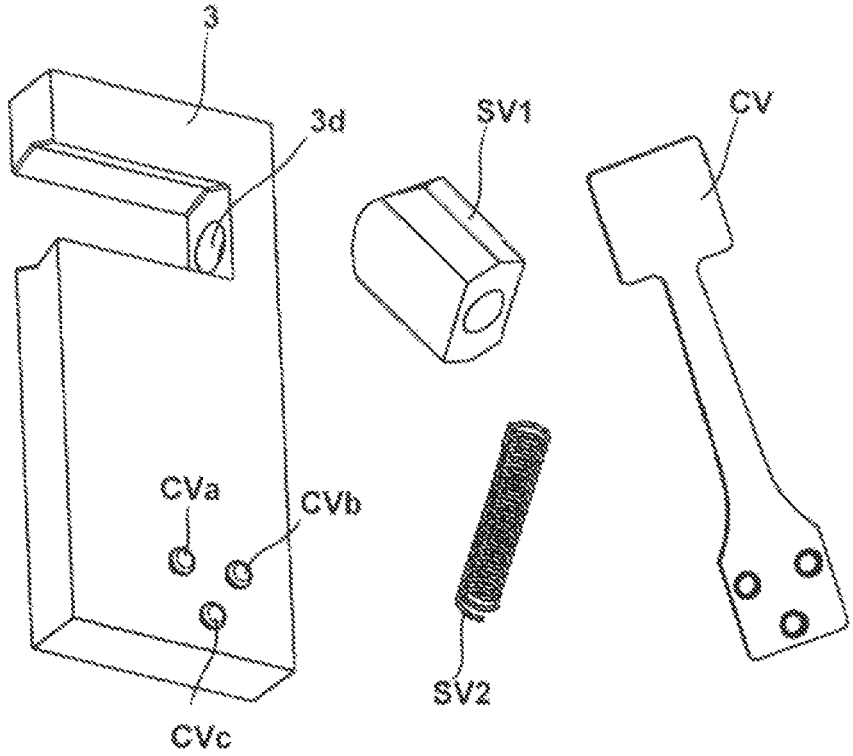

The additional setup of the sealing strip according to FIGS. 2A and 2B is visible from the individual part diagram according to FIG. 2C. The sealing strip 3 shown here, the control valve element SV1, the spring device SV2, and the check valve device CV formed as a leaf spring valve are assembled into a sub-assembly. Here, the check valve device CV is initially fixed via the fasteners CVa, CVb, CVc visible here on the sealing strip 3. Then the spring device SV2 is inserted into the blind hole 3*d* provided for positioning this device. Then the control valve element SV1 is inserted into the guide pocket.

Figure 3A:
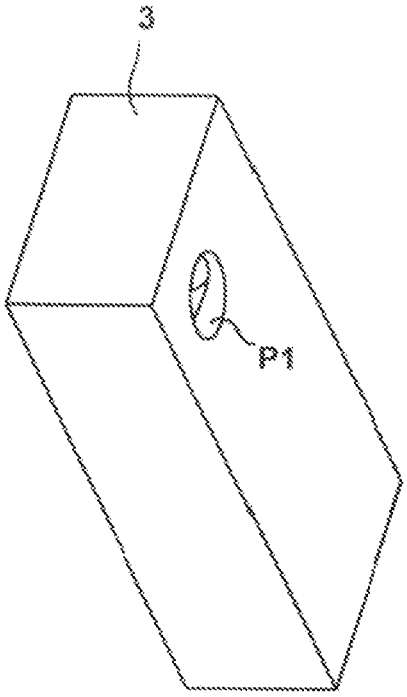
Figure 3B:
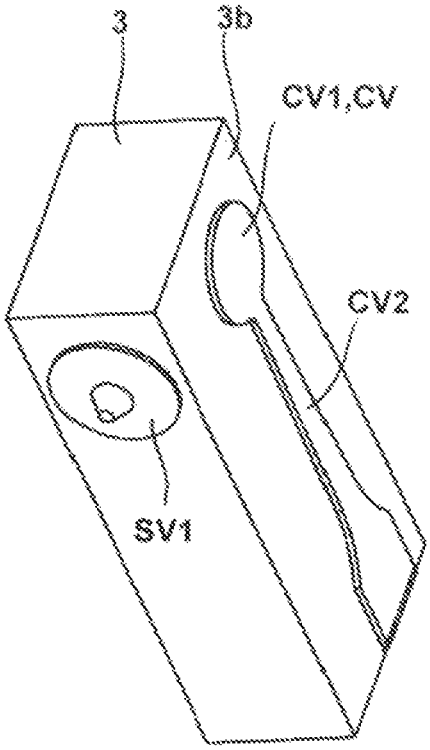
Figure 3C:
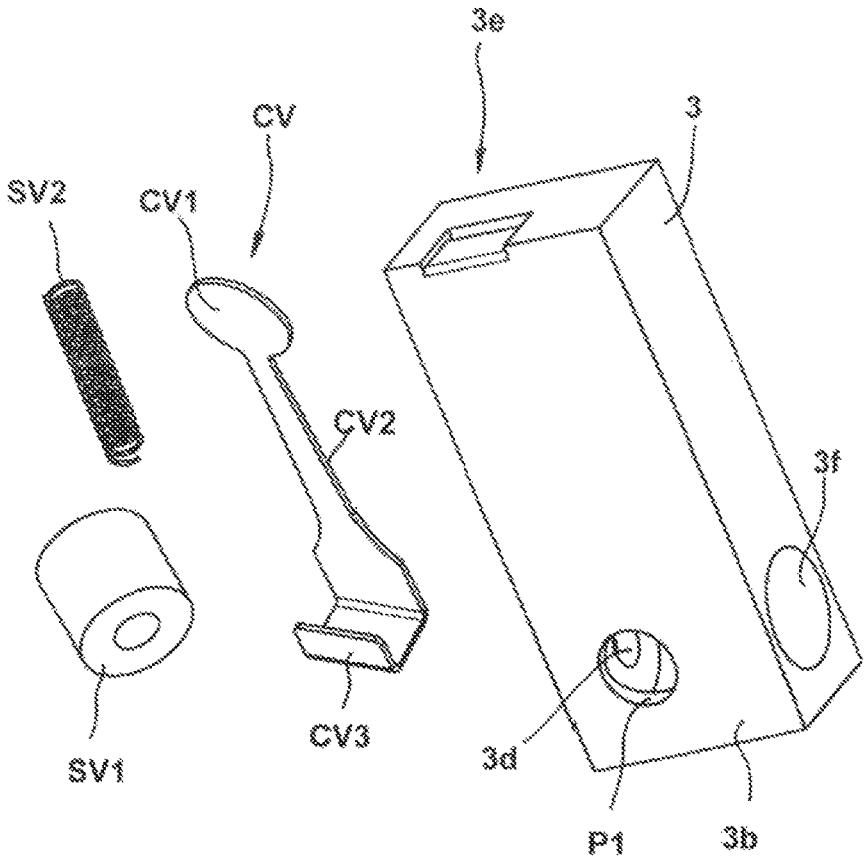

FIGS. 3A, 3B, and 3C show the setup of another embodiment of a sealing strip 3 with integrated check valve device for a control time actuating device according to the invention. The diagram according to FIG. 3A here shows the block-shaped setup of the sealing strip 3. This sealing strip is provided with a hole P1. As is visible from the diagram according to FIG. 3B, the valve plate CV1 of the check valve device CV sits on the flat side 3*b* of the sealing strip 3 in a sealing manner such that a fluid passage is realized through the passage hole P1 shown in FIG. 3*a* only when a fluid pressure is applied to the bottom side of the head section open toward the passage hole P1, where this pressure is sufficient to lift the valve plate CV1 from the flat side 3*b* against the valve closing force applied by the spring arm section CV2. As is further visible from the diagram according to FIG. 3B, a cylindrical blind hole is formed in the sealing strip 3, in which a control valve element SV1 shaped here as a cylindrical journal is inserted so that it can move axially.

The additional setup of the sealing strip according to FIG. 3B is shown in the individual part diagram according to FIG. 3C. As is visible from this diagram, in the variant, the spring arm section CV2 of the check valve device CV is fixed on the sealing strip 3 by means of retaining foot CV3 formed integrally with the spring arm section CV2. Here, an insertion pocket 3*e* is formed on the sealing strip 3, in which the retaining foot CV3 can be inserted. Through the formation of the check valve device CV shown here, the spring arm section CV2 is fixed on the sealing strip 3 and the valve plate CV1 is positioned over the passage hole P1 such that the bottom side of the valve plate CV1 visible here sits on the flat side 3*b* of the sealing strip facing the viewer. After joining the check valve device CV on the sealing strip 3, the spring device SV2 is inserted into the blind hole 3*d* visible here. Then the control valve element SV1 is inserted into the valve element hole 3*f* formed as a cylindrical hole.

Figure 4A:
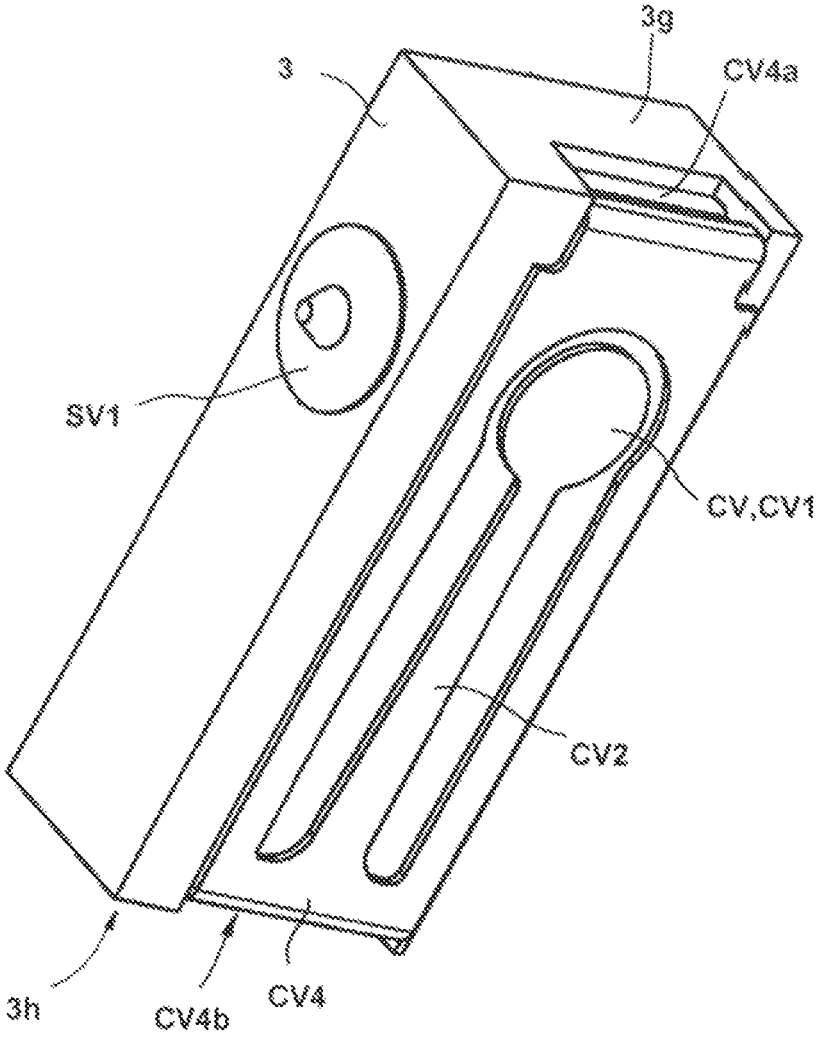
Figure 4B:
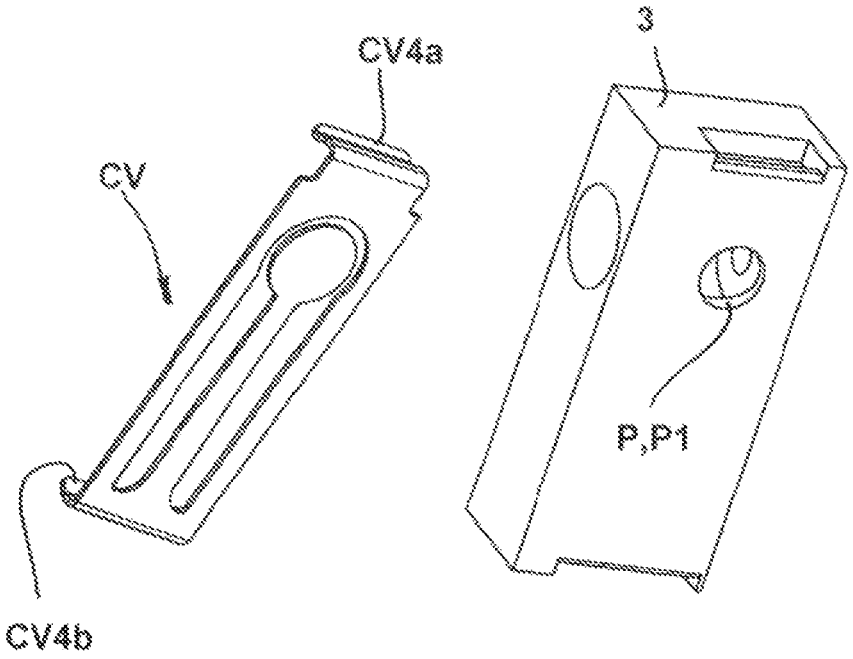

The diagrams according to FIGS. 4A, 4B show another embodiment of a sealing strip for a control time actuating device according to the invention, which has, as such, a check valve device CV and a fluid connection path P (see FIG. 4B) guiding through the sealing strip 3. In this embodiment, the check valve device CV is made, in turn, from a spring steel flat material and comprises a valve plate CV1, a spring arm section CV2, and a retaining device CV4 formed with the spring arm section CV2. The retaining device CV4 here has a frame that borders the spring arm section CV2 and the valve plate CV1 and is provided in the area of its end sections projecting toward the end sides 3*g*, 3*h* of the sealing strip 3 with retaining clamps CV4*a*, CV4*b*. The retaining clamps CV4*a*, CV4*b* engage in latching grooves that are formed correspondingly in the area of the previously mentioned end sides 3*g*, 3*h* of the sealing strip 3. A control valve element SV1 is inserted into the sealing strip 3 in the same way as in the variant according to FIGS. 3A to 3C. Through this control valve element SV1 it is possible to block the fluid connection path P controlled by the check valve device CV.

The diagram according to FIG. 4B here shows the sealing strip assembly shown in FIG. 4A in its individual parts. In this individual part diagram, in particular, the retaining clamp sections CV4*a*, CV4*b* provided on the check valve device CV for fixing this device on the sealing strip 3 are visible. The check valve device is produced as a stamped or cut component. The retaining clamp sections CV4*a*, CV4*b* are produced by plastic shaping of the output material.

Figure 5A:
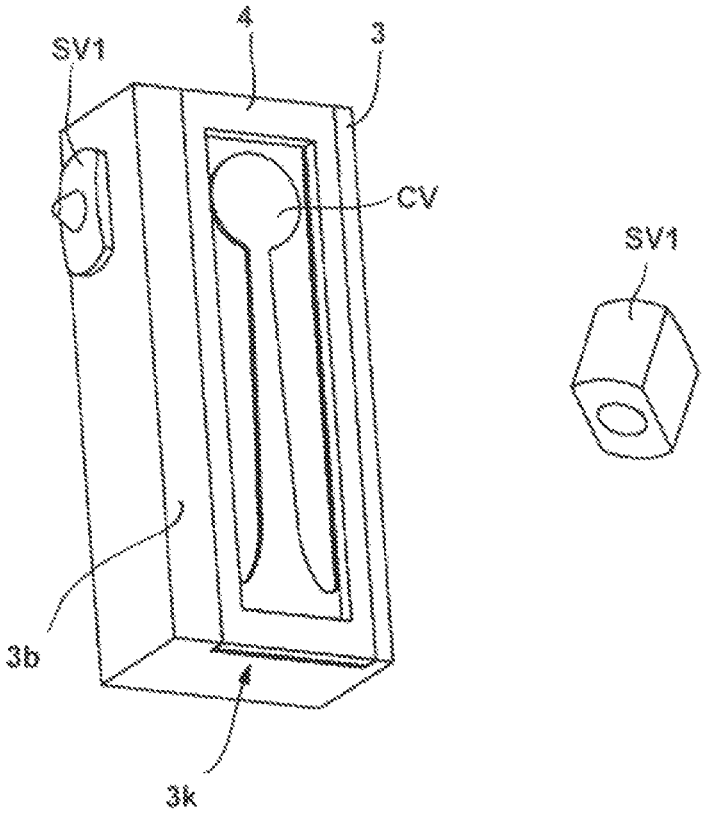
Figure 5B:
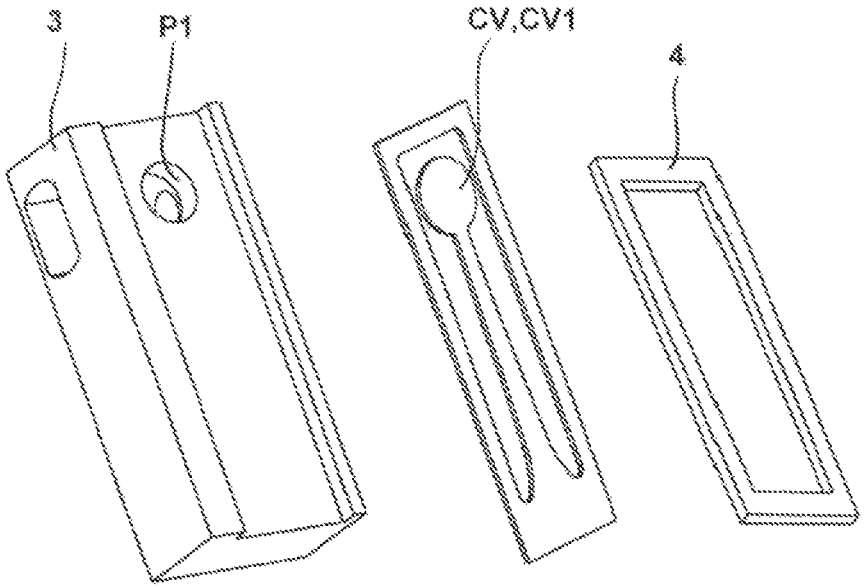

The diagrams according to FIGS. 5A and 5B show the setup of a fourth variant of a sealing strip 3 according to the invention for a control time actuating device. The sealing strip 3 is formed as a block-shaped strip and is provided with a flat groove 3*k* extending on the flat side 3*b* in the longitudinal direction of the sealing strip 3. The check valve device CV formed as a leaf spring valve is inserted into this groove 3*k*. The check valve device CV is fixed in the groove 3*k* by a retaining frame 4. In the sealing strip 3, as in the previously described embodiments, a control valve element SV1 is inserted, through which the fluid connection path that can be blocked by means of the check valve device CV and that passes through the sealing strip 3, can be switched and blocked.

The diagram according to FIG. 5B here shows the setup of the block-shaped base body forming the sealing strip 3, the setup of the check valve device CV produced from a flat material, and the setup of the retaining frame 4 provided for fixing the check valve device CV on the sealing strip 3. The passage hole P1 formed in the sealing strip 3 can be blocked by the valve plate CV1. A valve element hole in which the control valve element SV1 can be inserted so that it can move is further formed in the sealing strip 3.

Figure 6:
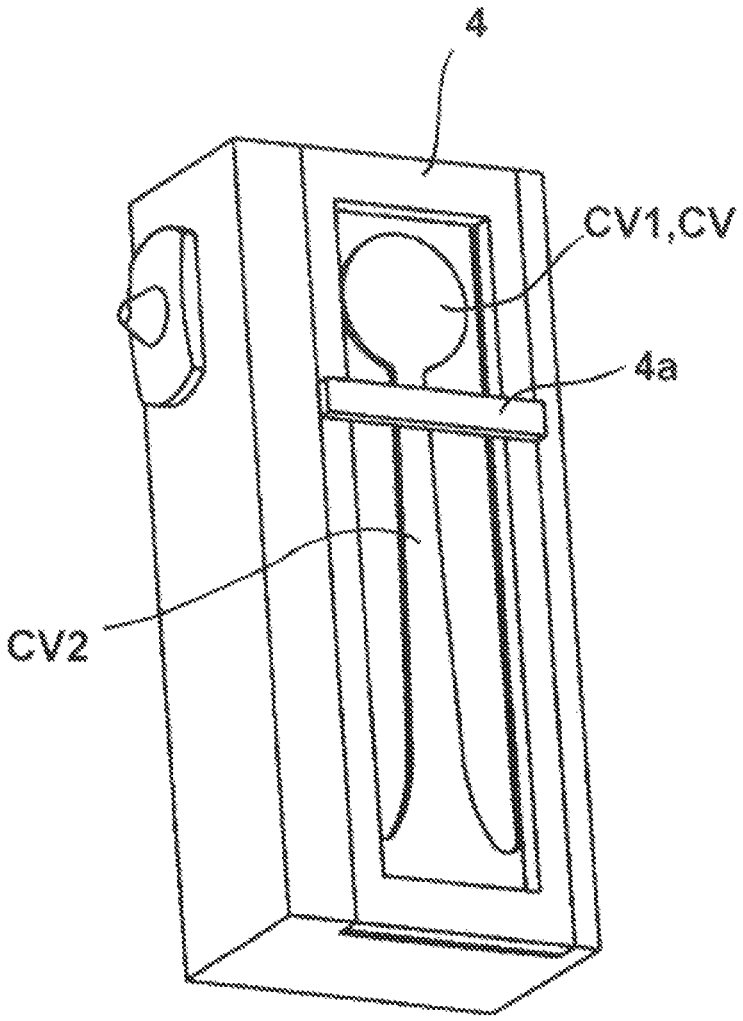

The diagrams according to FIG. 6 show a fifth variant of a sealing strip 3 with a passage channel P1 formed in this strip, as well as an integrated check valve device. For this embodiment, the explanations to FIGS. 5A and 5B apply accordingly. In this fifth variant, a stroke limiting device 4a is provided through which the maximum opening stroke of the valve plate CV1 of the check valve device CV is limited. The stroke limiting device 4*a* is here realized by a stop bar that forms part of the retaining frame 4. This stop bar limits the maximum extension of the spring arm section CV2 in the assembled state shown in FIG. 6 and thus the maximum opening stroke of the valve plate CV1.

LIST OF REFERENCE NUMBERS

Chamber housing
*d* Chamber housing cover
*e* Drive wheel
2 Actuating rotor
2*a* Dividing flanks
2*b* Base surface
2*c* Guide groove
2*d* Recess
2*e* Radial wall
3 Sealing strips
3*a* Flat sides
3*b* Flat side, side surface
3*c* Pocket
3*d* Blind hole
3*e* Insert pocket
3*f* Valve element hole
3*g* End side
3*h* End side
3*k* Groove
4 Retaining frame
4*a* Stroke limiting device
C Pressure chambers
C1 Chamber section
C2 Chamber section
CV Check valve device
CV1 Valve plate, valve head
CV2 Spring arm
CV3 Retaining foot
CVa Fastener
CVb Fastener
CVc Fastener
CV4*a* Retaining clamps
CV4*b* Retaining clamps
P Fluid connection path
P1 Passage hole
SP Oil channel
SV1 Control valve element
SV2 Spring device
X Axis of rotation

The invention claimed is:

1. A camshaft adjustment device for an internal combustion engine, the camshaft adjustment device comprising:

a chamber housing, an actuating rotor that is held in the chamber housing and pivots about an axis concentric to an axis of rotation of the chamber housing, a plurality of pressure chambers located between an inner surface of the chamber housing and the actuating rotor, wherein each of the plurality of pressure chambers includes:

a sealing strip inserted into the actuating rotor that divides the respective pressure chamber into a first chamber section and a second chamber section, a fluid connection path formed in said sealing strip, said fluid connection path connects the first and the second chamber sections and said fluid connection path includes a check valve device, and the sealing strip is inserted so as to be radially moveable in a guide groove formed in a dividing flank of the actuating rotor and a guide geometry is formed in said sealing strip and a valve element is guided on said guide geometry such that the valve element is moveable into different positions according to an oil pressure applied to the valve element, and an opening amount of the fluid connection path is adjustable by said valve element.

2. The camshaft adjustment device according to claim 1, wherein the fluid connection path is formed by a hole or recess that extends through the sealing strip.

3. The camshaft adjustment device according to claim 1, wherein the check valve device comprises a valve plate.

4. The camshaft adjustment device according to claim 3, wherein the valve plate is made from a steel material.

5. The camshaft adjustment device according to claim 4, wherein the valve plate is made of a structurally treated spring steel.

6. The camshaft adjustment device according to claim 3, wherein the valve plate is connected to a spring arm, and said spring arm has a smaller width than a head section of the valve plate that blocks the fluid connection path.

7. The camshaft adjustment device according to claim 6, wherein the spring arm is positioned on the sealing strip.

8. The camshaft adjustment device according to claim 7, wherein a flat depression is formed in the sealing strip and the valve plate is placed and positioned within the flat depression.

9. The camshaft adjustment device according to claim 7, wherein the spring arm is fixed directly to or in connection with a fixing element on the sealing strip.

10. The camshaft adjustment device according to claim 1, wherein the actuating rotor comprises at least one dividing flank holding one said sealing strip and each said at least one dividing flank is constructed with a recess in an area of the fluid connection path, the recess is open towards the inner surface of the chamber housing extending in a radial or circumferential direction.

* * * * *